US007355356B2

(12) United States Patent
Mudra

(10) Patent No.: US 7,355,356 B2
(45) Date of Patent: Apr. 8, 2008

(54) CIRCUIT ARRANGEMENT AND METHOD FOR DETECTING A CREST FACTOR OF A LAMP CURRENT OR A LAMP OPERATING VOLTAGE OF AN ELECTRIC LAMP

(75) Inventor: Thomas Mudra, Kastl (DE)

(73) Assignee: Patent-Treuhand-Gesellschaft für Elektrische Glühlampen mbH, München (DE)

( * ) Notice: Subject to any disclaimer, the term of this patent is extended or adjusted under 35 U.S.C. 154(b) by 179 days.

(21) Appl. No.: 11/449,838

(22) Filed: Jun. 9, 2006

(65) Prior Publication Data

US 2006/0279231 A1 Dec. 14, 2006

(30) Foreign Application Priority Data

Jun. 10, 2005 (DE) ..... 10 2005 027 012

(51) Int. Cl.
*G05F 1/00* (2006.01)

(52) U.S. Cl. ..... 315/307; 315/308; 315/291; 315/224; 315/209 R

(58) Field of Classification Search ..... 315/307, 315/308, 310, 291, 297–302, 224, 225, 209 R, 315/194
See application file for complete search history.

(56) References Cited

U.S. PATENT DOCUMENTS 3,502,983 A 3/1970 Ingle et al.
5,220,276 A 6/1993 Kleefstra
5,363,020 A 11/1994 Chen et al.
6,927,539 B2 * 8/2005 Arimoto et al. ..... 315/59
2002/0033679 A1 * 3/2002 Hui et al. ..... 315/307

FOREIGN PATENT DOCUMENTS

WO 00/40058 A1 7/2000
WO 02/19779 A1 3/2002
WO 2004/028206 A2 4/2004

OTHER PUBLICATIONS

European Search Report dated Sep. 26, 2007 regarding Application No. 06011752.0-1239.

* cited by examiner

*Primary Examiner*—Tuyet Vo
(74) *Attorney, Agent, or Firm*—Carlo S. Bessone

(57) ABSTRACT

The invention relates to a circuit arrangement for detecting a crest factor of a lamp current or a lamp operating voltage of an electric lamp (2), the circuit arrangement having a first subcircuit (15), which is designed to determine an averaged value from an input signal applied to the circuit arrangement, having a second subcircuit (16), which is designed to determine a maximum permissible value from the input signal applied to the circuit arrangement and having a comparator circuit (17), which is designed to produce a comparison signal from the output signal of the first subcircuit (15) characterizing the averaged value and from an output signal of the second subcircuit (16) characterizing the maximum permissible crest factor. The invention also relates to a method for detecting such a crest factor. One further aspect of the invention relates to an electronic ballast (1) which has a circuit arrangement (14*a*, 14*b*) according to the invention. Furthermore, the invention also relates to a method for operating an electric lamp, in which a crest factor is detected in accordance with a method according to the invention.

20 Claims, 1 Drawing Sheet

CIRCUIT ARRANGEMENT AND METHOD FOR DETECTING A CREST FACTOR OF A LAMP CURRENT OR A LAMP OPERATING VOLTAGE OF AN ELECTRIC LAMP

FIELD OF THE INVENTION

The invention relates to a circuit arrangement for detecting a crest factor of a lamp current or a lamp operating voltage of an electric lamp. Furthermore, the invention relates to a method for detecting such a crest factor. In addition, the invention also relates to an electronic ballast having a circuit arrangement for detecting an abovementioned crest factor and a method for operating an electric lamp using an electronic ballast, in which a crest factor is detected in accordance with the abovementioned method.

BACKGROUND OF THE INVENTION

When dimming electric lamps, in particular fluorescent lamps having electronic ballasts, an oscillation can typically be formed in the lower region of the dimming range, in particular in the lower third of the dimming range, and this oscillation results owing to the interaction of the lamp characteristic, the resonant circuit and the regulation. This range, which is also referred to as the "frequency reversal" range, occurs to a particularly severe extent during a run up phase of amalgam lamps. At extreme ambient temperatures, such a "frequency reversal" range is also observed in the case of mercury lamps. This oscillation brings about severe modulation of the lamp current at frequencies of from 30 Hz to 10 kHz and cannot usually be recognized as optical instability. The high crest factor of the lamp current which is caused thereby can, however, result in severe damage to the electric lamp and have a life-shortening effect.

In order to avoid operation with a high lamp current crest factor, attempts are made to keep the range of "frequency reversal" small by means of suitably selecting the resonant circuit and the regulation and to reduce the damaging effect of the high crest factor by means of increased lamp filament heating. Furthermore, either the range for the permissible ambient temperature for the dimming operation is restricted or the permissible dimming range at extreme ambient temperatures is reduced. In addition, it is also known in the case of some operating devices, in particular electronic ballasts, for amalgam lamps for the full dimming function to be released only after a predetermined period of time after they have been switched on, in order, as a result, to bridge the run up phase.

SUMMARY OF THE INVENTION

The present invention is therefore based on the object of providing a circuit arrangement for detecting a crest factor of a lamp current or a lamp operating voltage of an electric lamp and a method for detecting such a crest factor, by means of which circuit arrangement and method it is possible to prevent an electric lamp from being operated at a high crest factor. Furthermore, one object of the invention is to provide an electronic ballast which has a circuit arrangement for detecting a crest factor of an electric lamp, and a method for operating an electric lamp using an electronic ballast, with which the damaging effect of an excessively high crest factor on an electric lamp can be prevented and reliable and safe operation of the electric lamp can be made possible.

A circuit arrangement according to the invention for detecting a crest factor of an electric lamp is designed both to detect a lamp current crest factor and a lamp operating voltage crest factor. The circuit arrangement has a first subcircuit, this first subcircuit being designed to determine an averaged value from an input signal applied to the circuit arrangement. Furthermore, the circuit arrangement comprises a second subcircuit, which is designed to determine a maximum value from the input signal applied to the circuit arrangement. As a further essential feature, the circuit arrangement has a comparator circuit, the comparator circuit being designed to produce an output signal in the form of a comparison signal. The comparison signal which can be produced by the comparator circuit can in this case be produced from the output signal of the first subcircuit characterizing the averaged value and from an output signal of the second subcircuit characterizing the maximum permissible crest factor. The output signal of the second subcircuit can be produced whilst taking into account the signal characterizing the maximum value for the input signal. The circuit arrangement according to the invention is thus designed such that operation of an electric lamp with a high crest factor, in particular a high lamp current crest factor or a high lamp operating voltage crest factor, can be prevented. As a result, it is also possible to achieve a situation in which the electric lamp can be prevented from being impaired in a damaging and life-shortening manner. Owing to the circuit arrangement in accordance with the invention, it is possible to avoid the setting and operation of an electric lamp being influenced in an interfering manner by means of a "frequency reversal" range.

The first subcircuit is advantageously in the form of a low-pass filter circuit. In one preferred embodiment, the low-pass filter circuit in this case comprises a resistor and a capacitor, which are electrically connected to a first circuit node of the first subcircuit. Furthermore, in one preferred embodiment, the capacitor can be connected at a second electrical connection to ground potential.

An output of the first subcircuit is preferably electrically connected to a first input of the comparator circuit and an output of the second subcircuit is electrically connected to a second input of the comparator circuit. The output signals of the first and the second subcircuits are thus applied to different inputs of the comparator circuit, which is advantageously in the form of a comparator.

The second subcircuit is advantageously electrically connected to a first input connection of the circuit arrangement and, in a preferred embodiment, comprises a diode and a capacitor, which are electrically connected to a first circuit node of the second subcircuit.

The second subcircuit is preferably designed to scale the signal which characterizes the maximum permissible crest factor and to input a time constant for this signal which characterizes this maximum permissible crest factor. For this purpose, provision may advantageously be made for the second subcircuit to have two resistors. This may make it possible for the signal characterizing the peak value of the crest factor or the maximum permissible crest factor to be produced by means of the adjustment of the time constant in a variable and flexible manner, even for a relatively long period of time, and in particular for this signal to be provided at the second input of the comparator circuit for a relatively long period of time.

A third subcircuit may preferably be provided, this third subcircuit being designed to condition and rectify the input signal which is applied to the circuit arrangement. By means of such signal conditioning and rectification, it is possible for the detection of the crest factor to be carried out in a substantially improved and more precise manner.

The third subcircuit has an output which is advantageously electrically connected to an input of the first subcircuit. The third subcircuit preferably comprises at least two diodes and a resistor. As a result, the third subcircuit can be implemented in a relatively simple and low-complexity manner and an input signal can be provided which has been conditioned very well for further processing purposes and rectified. The crest factor of the lamp current or the lamp operating voltage of the electric lamp can preferably be detected at least partially digitally. In one advantageous embodiment, a microprocessor is provided, in which at least one of the operations which can be carried out in the subcircuits and/or the comparator circuit can be carried out digitally.

The comparison signal of the comparator circuit can preferably be provided for the purpose of setting the crest factor. The circuit arrangement is thus designed such that the comparison signal produced by the comparator circuit can be transmitted, as the output signal of the circuit arrangement, to further units which are provided for operating and for setting an electric lamp, and it is thus possible for the crest factor of a lamp current or a lamp operating voltage to be set in a precise and safe manner. Safe operation of the electric lamp can therefore be carried out with little complexity.

One further aspect of the invention relates to an electronic ballast for an electric lamp which has a circuit arrangement according to the invention or an advantageous embodiment of the circuit arrangement according to the invention. This makes it possible to achieve a situation in which electric lamps in the form of fluorescent lamps, which are electrically connected to electronic ballasts, can be operated and set in a reliable manner. In particular when dimming these fluorescent lamps, it is thus possible for a damaging or life-shortening effect owing to a "frequency reversal" range to be prevented, since the occurrence of high crest factors of the lamp current or the lamp operating voltage can be avoided.

The circuit arrangement arranged in the electronic ballast is preferably electrically connected at a first connection to a first lamp filament. Furthermore, the circuit arrangement is also electrically connected at this input to a half-bridge inverter. The electrical wiring of the circuit arrangement in the electronic ballast is in this case such that a crest factor can be detected precisely in a simple and reliable manner.

The circuit arrangement in the electronic ballast preferably has an output, which is electrically connected to a regulating unit of the electronic ballast. The comparison signal which is provided as the output signal by the circuit arrangement can thus be transmitted directly to this regulating unit for further processing and evaluation purposes and can be provided for the purpose of setting the lamp parameters and thus also the crest factor of the electric lamp.

Provision may be made for the electronic ballast to be electrically connected to a fluorescent lamp, in particular an amalgam lamp or a mercury lamp, for setting and operation purposes. Precisely in the case of these lamps, it is thus possible for safe operation to be carried out without an excessively high crest factor of the lamp current or the lamp operating voltage.

In a method according to the invention for detecting a crest factor of a lamp operating voltage or a lamp current of an electric lamp by means of a circuit arrangement, an averaged value is determined from an input signal applied to the circuit arrangement in a first method step by means of a first subcircuit. Furthermore, a maximum value is determined from this input signal applied to the circuit arrangement by means of a second subcircuit. An output signal characterizing the maximum permissible crest factor is determined or produced from the signal characterizing the maximum value by means of the second subcircuit. From the output signal of the first subcircuit which characterizes the averaged value and an output signal of the second subcircuit which characterizes the maximum permissible crest factor, in a further method step a comparison of these two signals is carried out. The comparison signal produced by the comparison is provided as the output signal of the circuit arrangement. Owing to the method according to the invention, a crest factor of the lamp current or the lamp operating voltage can be detected in a simple and precise manner with little complexity. The comparison signal produced in the method according to the invention can then be used as the information signal for further setting and regulation of lamp parameters, such that the operation of an electric lamp with an excessively high crest factor of the lamp current or the lamp operating voltage can be prevented.

The input signal is advantageously conditioned and rectified prior to the determination of the averaged value.

One further aspect of the invention relates to a method for operating an electric lamp which is electrically connected to an electronic ballast, in this method according to the invention for operating the electric lamp, a crest factor of a lamp operating voltage or a lamp current being detected in accordance with an above-explained method according to the invention for detecting such a crest factor. This makes it possible to achieve a situation in which the electric lamp can be operated and set in a safe and reliable manner.

Further refinements of the invention are specified in the dependent claims.

Advantageous refinements of the circuit arrangement according to the invention and the electronic ballast according to the invention are, where transferable, also regarded as refinements according to the invention of the method according to the invention for detecting a crest factor of a lamp operating voltage or a lamp current of an electric lamp and the method according to the invention for operating an electric lamp.

In the invention, a crest factor of the lamp current or the lamp operating voltage is thus determined using a suitable circuit arrangement, which is preferably arranged in an electronic ballast, using a measurement of the lamp current or the lamp operating voltage. The determined crest factor is compared with a permissible maximum value, it being possible, in the event of the maximum value being exceeded by the determined value of the crest factor, for a power of the electric lamp to be increased until the determined value falls below the permissible maximum value again. It is also possible with the invention to achieve a situation in which, in critical phases of operation, in particular during the run up phase of the electric lamp, the dimming range virtually has a lower limit, but only as far as is required or only to a minimum extent.

BRIEF DESCRIPTION OF THE DRAWINGS

Exemplary embodiments of the invention will be explained in more detail below with reference to schematic drawings, in which.

DETAILED DESCRIPTION OF THE INVENTION

Figure 1:
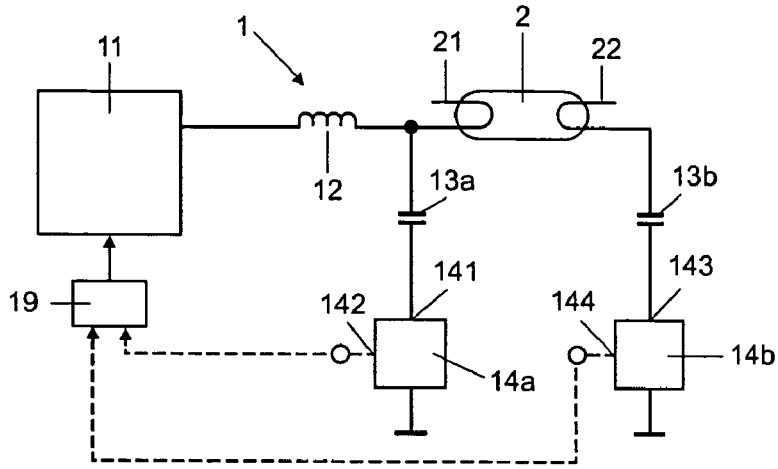
FIG. 1 shows a first and second exemplary embodiment of an electronic ballast according to the invention, which is connected to an electric lamp.
Figure 2:
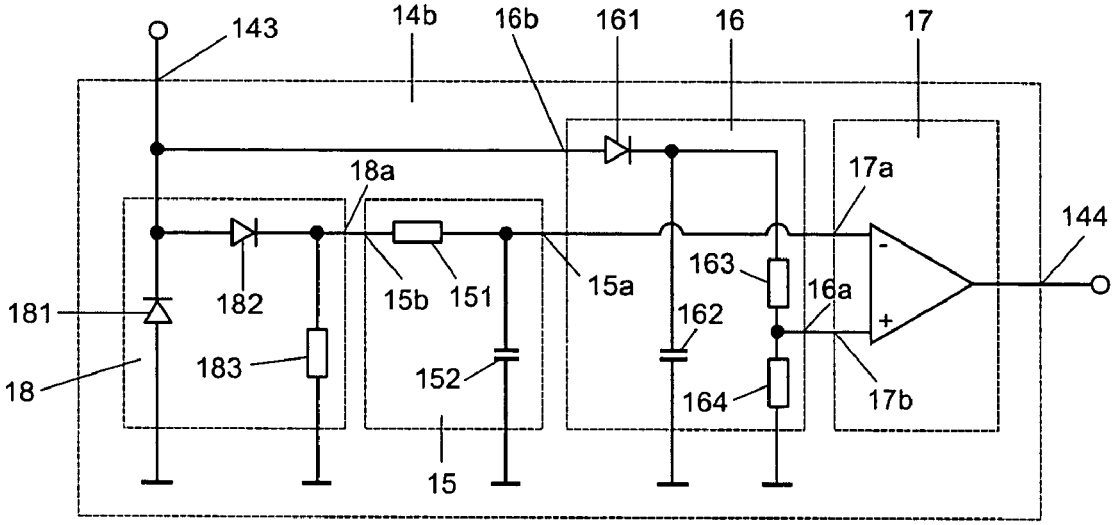
FIG. 2 shows an illustration of a circuit arrangement according to the invention for detecting a crest factor of a lamp current or a lamp operating voltage.

Identical or functionally identical elements are provided with the same reference symbols in FIGS. 1 and 2.

FIG. 1 shows a schematic illustration of an electronic ballast 1. The electronic ballast 1 is electrically connected to an electric lamp, which, in the exemplary embodiment shown, is in the form of a fluorescent lamp 2.

The illustration shown in FIG. 1 shows two different exemplary embodiments of the invention. First, the implementation of the first exemplary embodiment will be explained in more detail below. The electronic ballast 1 has a half-bridge inverter 11, which is electrically connected at one output to an inductance 12. The inductance 12 is furthermore electrically connected to a first lamp filament 21 of the fluorescent lamp 2. Furthermore, the inductance 12 also has an electrical connection to a capacitor, which in the exemplary embodiment is in the form of a starting capacitor 13*a*. Note will be made of the fact that the starting capacitor 13*a* may also be in the form of an element of a voltage divider circuit for lamp voltage measurement, which can also be realized in the form of a resistance divider circuit. Furthermore, the electronic ballast 1 comprises a circuit arrangement 14*a* according to the invention for detecting a crest factor of a lamp operating voltage which is electrically connected at a first input 141 to the first lamp filament 21 via the starting capacitor 13*a*. In the signal path between the inductance 12 and the first lamp filament 21 and in the signal path between the inductance 12 and the circuit arrangement 14*a*, a signal characterizing the lamp operating voltage is transmitted. Furthermore, a further capacitor, which in the exemplary embodiment is in the form of a half-bridge capacitor 13*b*, is connected to a second lamp filament 22. Furthermore, the half-bridge capacitor 13*b* in the first exemplary embodiment has an electrical connection to ground potential. Note will be made of the fact that, in the first exemplary embodiment, a circuit arrangement 14*b* is not provided.

As can also be seen from the illustration in FIG. 1, the circuit arrangement 14*a* has a first output 142, which is electrically connected to a regulating unit 19. Furthermore, the circuit arrangement 14*a* is electrically connected at a second output to ground potential. The regulating unit 19 is furthermore electrically connected at one output to an input of the half-bridge inverter 11. In the first exemplary embodiment explained above, the circuit arrangement 14*a* according to the invention for detecting the crest factor of the lamp operating voltage is thus formed.

The second exemplary embodiment of the electronic ballast 1 according to the invention, which is likewise illustrated in FIG. 1, will be explained in more detail below. Note will be made of the fact that, in this second exemplary embodiment, the circuit arrangement 14*a* is not formed. In this second exemplary embodiment, the starting capacitor 13*a* is connected to ground potential. Instead of the circuit arrangement 14*a*, in the second exemplary embodiment the circuit arrangement 14*b* for detecting the crest factor of the lamp current is formed. The circuit arrangement 14*b* is electrically connected at a first input 143 to the half-bridge capacitor 13*b*. In accordance with the first exemplary embodiment, in the second exemplary embodiment too, the circuit arrangement 14*b* has a first output 144, which is electrically connected to the regulating unit 19, a second output of the circuit arrangement 14*b* being connected to ground potential. Mention will be made of the fact that an electronic ballast 1 according to the invention is realized either in accordance with the first exemplary embodiment or in accordance with the second exemplary embodiment. An embodiment in which both the signal path from the inductance 12 via the starting capacitor 13*a* via the circuit arrangement 14*a* to the regulating unit 19 and also the signal path from the second lamp filament 22 via the half-bridge capacitor 13*b* via the circuit arrangement 14*b* to the regulating unit 19 are realized is not provided.

FIG. 2 shows a detailed illustration of a circuit arrangement 14*a* or 14*b* according to the invention for detecting a crest factor of a lamp operating voltage or a lamp current. For a more detailed explanation, the circuit arrangement 14*b* for detecting the crest factor of the lamp current will be considered in more detail below. As can be seen from FIG. 2, the circuit arrangement 14*b* according to the invention has a first subcircuit 15, which is designed to determine an averaged value of the lamp current from an input signal applied to the circuit arrangement 14*b* via the input connection 143. The first subcircuit 15 is, in the exemplary embodiment, in the form of a low-pass filter circuit and has a resistor 151 and a capacitor 152. The resistor 151 is electrically connected at a first end to an input 15*b* of the first subcircuit 15 and at a second end to a circuit node of the first subcircuit 15. The capacitor 152 is likewise connected to the circuit node of the first subcircuit 15 and also has a second electrical connection to ground potential.

Furthermore, the circuit arrangement 14*b* comprises a second subcircuit 16, which, in the exemplary embodiment, is designed to determine a maximum permissible value of the lamp current from the input signal applied to the circuit arrangement 14*b*. As can be seen, the second subcircuit 16 has an input 16*b*, which is electrically connected to the input connection 143 of the circuit arrangement 14*b*. In order to produce a maximum permissible value from the input signal, the second subcircuit 16 has a diode 161 and a capacitor 162. In this case, the diode 161 is connected at its anode to the input 16*b* of the second subcircuit 16. With its cathode, the diode 161 is electrically connected to a first circuit node of the second subcircuit 16. The capacitor 162 is also electrically connected to this first circuit node, this capacitor 162 being electrically connected at its second end to ground potential. In the exemplary embodiment shown in FIG. 2, the second subcircuit 16 also has two resistors 163, 164, which are designed to scale the signal and to input a time constant for this signal, which characterizes the maximum permissible crest factor. As can be seen from the illustration in FIG. 2, the resistor 164 is connected to ground potential and is connected to a second circuit node of the second subcircuit 16. The first resistor 163 is connected between the two circuit nodes of the second subcircuit 16. As can be seen from the illustration in FIG. 2, the first subcircuit 15 is connected at an output 15*a* to a first input 17*a* of a comparator circuit 17. One output 16*a* of the second subcircuit 16 is electrically connected to a second input 17*b* of this comparator circuit 17. The comparator circuit 17 is, in the exemplary embodiment, in the form of a comparator.

Furthermore, the circuit arrangement 14*b*, in the exemplary embodiment illustrated, comprises a third subcircuit 18, which is designed to condition and rectify the input signal which is applied to the input 143. The third subcircuit comprises a first diode 181 and a second diode 182. The first diode 181 is connected at its anode to ground potential, in which case it is connected at its cathode to a first circuit node of the third subcircuit. Furthermore, the second diode 182 is connected at its anode to the first circuit node and at its cathode to a second circuit node of the third subcircuit 18. Furthermore, the third subcircuit 18 also comprises a resistor 183, which is electrically connected to the second circuit node and to ground potential. As can be seen from the illustration in FIG. 2, an output 18*a* of the third subcircuit 18 is electrically connected to the input 15*b* of the first subcircuit 15.

The input signal applied to the input 143 is thus transmitted to the third subcircuit 18 for conditioning and rectification purposes. The input signal rectified and conditioned by this third subcircuit 18 is then transmitted to the first subcircuit 15, in which a signal is generated which characterizes the averaged value of the lamp current. In a corresponding manner, the input signal applied to the input 143 is transmitted to the second subcircuit 16, in which a maximum permissible value is determined and in which an output signal is produced which characterizes the maximum permissible crest factor. Then, a comparison between the output signals of the subcircuits 15 and 16 is carried out in the comparator circuit 17, and the comparison signal produced by the comparator of the comparator circuit 17 is provided as the output signal of the circuit arrangement 14*b* at the output 144 and is transmitted to the regulating unit 19. In this regulating unit 19, regulation as regards a desired value for the crest factor of the lamp current is then carried out and a corresponding signal is transmitted to the half-bridge inverter 11. By means of the invention, the fluorescent lamp 2 can be operated without an excessively high crest factor, in which case it is thus possible to prevent damaging or life-shortening operation of the fluorescent lamp 2.

Provision may also be made for at least some of the subcircuits 15, 16 and 18 and/or the comparator circuit 17 to be in the form of digital circuits and thus for it to be possible for the respective operations carried out in the subcircuits to be detected digitally. Provision may be made in a particularly advantageous manner for the subcircuits 15, 16 and 18 and the comparator circuit 17 to be realized in a microprocessor and for the entire detection of the crest factor, as is carried out in the circuit arrangement 14*b*, to take place in a digital manner. This means that the averaging, peak-value detection, scaling, time response and the threshold value comparison are carried out on a digital basis.

The circuit arrangement 14*a* has a similar design to the circuit arrangement 14*b*.

The invention claimed is:

1. A circuit arrangement for detecting a crest factor of a lamp current or a lamp operating voltage of an electric lamp (2), the circuit arrangement having a first subcircuit (15), which is designed to determine an averaged value from an input signal applied to the circuit arrangement, having a second subcircuit (16), which is designed to determine a maximum value from the input signal applied to the circuit arrangement; and having a comparator circuit (17), which is designed to produce a comparison signal from an output signal of the first subcircuit (15) characterizing the averaged value and from an output signal of the second subcircuit (16) characterizing the maximum permissible crest factor.

2. The circuit arrangement as claimed in claim 1, characterized in that the output (15*a*) of the first subcircuit (15) is electrically connected to a first input (17*a*) of the comparator circuit (17) and an output (16*a*) of the second subcircuit (16) is electrically connected to a second input (17*b*) of the comparator circuit (17).

3. The circuit arrangement as claimed in claim 1, characterized in that the second subcircuit (16) is electrically connected at one input (16*b*) to a first input connection (141; 143) of the circuit arrangement (14*a*, 14*b*), the second subcircuit (16) having a diode (161) and a capacitor (162).

4. The circuit arrangement as claimed in claim 1, characterized in that the second subcircuit (16) is designed to scale the signal which characterizes the maximum permissible crest factor and to input a time constant for the signal which characterizes the maximum permissible crest factor.

5. The circuit arrangement as claimed in one claim 1, characterized in that the comparison signal of the comparator circuit (17) can be provided for the purpose of setting the crest factor.

6. The circuit arrangement as claimed in claim 1, characterized in that the first subcircuit (15) is in the form of a low-pass filter circuit.

7. The circuit arrangement as claimed in claim 6, characterized in that an output (15*a*) of the first subcircuit (15) is electrically connected to a first input (17*a*) of the comparator circuit (17) and an output (16*a*) of the second subscript (16) is electrically connected to a second input (17 *b*) of the comparator circuit (17).

8. The circuit arrangement as claimed in claim 1, characterized in that the crest factor of the lamp current or the lamp operating voltage can be detected at least partially digitally.

9. The circuit arrangement as claimed in claim 8, characterized by a microprocessor, in which at least one of the operations which can be carried out in the subcircuits (15, 16, 18) and/or the comparator circuit (17) can be carried out digitally.

10. The circuit arrangement as claimed in claim 1, characterized by a third subcircuit (18), which is designed to condition and rectify the input signal.

11. The circuit arrangement as claimed in claim 10, characterized in that the third subcircuit (18) is electrically connected at one output (18*a*) to an input (15*b*) of the first subcircuit (15).

12. The circuit arrangement as claimed in claim 6, characterized in that the third subcircuit (18) has at least two diodes (181, 182) and a resistor (183).

13. An electronic ballast for an electric lamp, which has a circuit arrangement (14*a;* 14*b*) as claimed in claim 1.

14. The electronic ballast as claimed in claim 13, characterized in that the circuit arrangement (14*a;* 14*b*) is electrically connected at one input (141; 143) to a lamp filament (21; 22).

15. The electronic ballast as claimed in claim 13, characterized in that the circuit arrangement (14*a;* 14*b*) is electrically connected at one first output (142; 144) to a regulating unit (19).

16. The electronic ballast as claimed in claim 13, characterized in that the electronic ballast (1) is electrically connected to a fluorescent lamp (2), in particular an amalgam lamp or a mercury lamp.

17. A method for detecting a crest factor of a lamp operating voltage or a lamp current of an electric lamp (2) by means of a circuit arrangement (14*a;* 14*b*), in which the following steps are carried out:

determining an averaged value from an input signal applied to the circuit arrangement (14*a;* 14*b*);

determining a maximum permissible value from the input signal applied to the circuit arrangement (14*a;* 14*b*);

determining a signal characterizing the maximum permissible crest factor;

carrying out a comparison between the signal which characterizes the averaged value and the signal which characterizes the maximum permissible crest factor; and providing a comparison signal characterizing the result of the comparison.

18. The method as claimed in claim 17, characterized in that the input signal is conditioned and rectified prior to the determination of the averaged crest factor.

19. A method for operating an electric lamp (2) which is electrically connected to an electronic ballast (1), in which a crest factor of a lamp operating voltage or a lamp current is detected in accordance with a method as claimed in claim 17.

20. The method as claimed in claim 19, characterized in that the method as claimed in is carried out in the electronic ballast (1).

* * * * *